US006213117B1

(12) United States Patent
Kirk et al.

(10) Patent No.: US 6,213,117 B1
(45) Date of Patent: Apr. 10, 2001

(54) MOTORIZED INSULATED DAMPER ASSEMBLY FOR FURNACE SYSTEMS

(75) Inventors: William Max Kirk, Denton; Timothy Gardner Wentz, Lincoln, both of NE (US)

(73) Assignee: Board of Regents of University of Nebraska, Lincoln, NE (US)

( * ) Notice: Subject to any disclaimer, the term of this patent is extended or adjusted under 35 U.S.C. 154(b) by 0 days.

(21) Appl. No.: 08/941,805

(22) Filed: Oct. 3, 1997

Related U.S. Application Data

(60) Provisional application No. 60/036,391, filed on Jul. 24, 1997.

(51) Int. Cl.[7] ..... F23L 11/00; F23L 13/00; F23L 3/00

(52) U.S. Cl. ..... 126/285 R; 126/285 B; 126/112; 126/85 B; 454/333; 236/1 G

(58) Field of Search ..... 126/285 R, 285 B, 126/112, 110 A, 110 R, 85 B, 77, 15 R, 307 A, 292, 293; 454/333, 353, 347, 265, 266, 251, 252; 236/1 G

(56) References Cited

U.S. PATENT DOCUMENTS

| | | | | |
|---|---|---|---|---|
| 1,767,869 | | 6/1930 | Baumgarten | 454/347 |
| 1,828,016 | | 10/1931 | Andres | 454/353 |
| 1,879,342 | * | 9/1932 | Lauter | 126/112 |
| 2,039,948 | * | 5/1936 | Best | 126/110 A |
| 2,224,705 | | 12/1940 | Stringer | 126/285 B |
| 2,467,018 | * | 4/1949 | Eggleston | 454/251 |
| 2,579,395 | * | 12/1951 | Pfautsch | 454/353 |
| 2,800,853 | | 7/1957 | Spear | 454/353 |
| 2,856,484 | | 10/1958 | Fairbanks | 126/285 B |
| 2,962,218 | * | 11/1960 | Dibert | 126/110 R |
| 3,004,484 | | 10/1961 | Lorenz | 454/333 |
| 3,821,924 | | 7/1974 | Walters | 126/286 |
| 3,964,377 | * | 6/1976 | Chapman | 454/353 |

(List continued on next page.)

FOREIGN PATENT DOCUMENTS

| | | |
|---|---|---|
| 278510 | 10/1951 | (CH) . |
| 720542 | 12/1954 | (GB) . |

OTHER PUBLICATIONS

IN–FORCER™ brochure, "The Cost–Effect Cure for Poor Indoor air Quality Due to Negative Pressure in Too–Tightly Constructed Homes," dated 1992.

IN–FORCER™ brochure, "The Cost–Effective, Safe Way to Ensure Adequate Adequate Combustion Air for Gas and Oil–Fired Heating Equipment," dated 1992.

*Primary Examiner*—Ira S. Lazarus
*Assistant Examiner*—Josiah C. Cocks
(74) *Attorney, Agent, or Firm*—Shook, Hardy & Bacon L.L.P.

(57) ABSTRACT

A damper unit is provided that is adapted to be positioned in a furnace duct line. The damper unit has a housing which is in communication with a fresh air source and a furnace system. The housing has a damper blade which is moveable between an open position which allows air flow through the housing and a closed position which prevents air flow through the housing. The blade is coupled with a solenoid so that when the solenoid is activated the blade is moved to an open position allowing air flow through the housing. Further, a fan is located in the housing adjacent the damper blade. The fan operates to move air into and out of the housing and across the damper blade when the damper blade is in its open position. In one embodiment, a pair of sealing ridges are provided on the interior of the housing. When the damper blade is in a closed position, it is in abutting relationship with the sealing ridges so that air flow across the closed damper blade is substantially prevented by the damper blade and the sealing ridges.

27 Claims, 3 Drawing Sheets

U.S. PATENT DOCUMENTS

| | | | | |
|---|---|---|---|---|
| 4,121,562 | * | 10/1978 | Grott | 126/85 B |
| 4,122,835 | | 10/1978 | Bowen, Jr. et al. | 126/286 |
| 4,141,336 | * | 2/1979 | Fitch | 126/112 |
| 4,193,541 | * | 3/1980 | Scheildweiler | 126/285 B |
| 4,206,744 | * | 6/1980 | Mahoney et al. | 126/285 R |
| 4,249,883 | * | 2/1981 | Woolfolk | 236/1 G |
| 4,292,950 | * | 10/1981 | Schossow | 126/112 |
| 4,372,196 | | 2/1983 | Henderson | 454/353 |
| 4,537,117 | * | 8/1985 | Cvaestany et al. | 454/338 |
| 4,777,928 | * | 10/1988 | Ellis | 126/112 |
| 4,920,866 | * | 5/1990 | Hoban | 454/251 |
| 5,012,793 | * | 5/1991 | Guzorek | 126/85 B |
| 5,056,500 | * | 10/1991 | Evens | 126/285 B |
| 5,385,299 | * | 1/1995 | Zawada | 126/110 R |

* cited by examiner

MOTORIZED INSULATED DAMPER ASSEMBLY FOR FURNACE SYSTEMS

This application claims the benefit of U.S. Provisional Application No. 60/036,391, filed Jan. 24, 1997.

BACKGROUND OF THE INVENTION

The present invention relates in general to furnace dampers, and more specifically, to furnace dampers which can selectively provide fresh air to a furnace while the furnace is in operation, and which can be effectively sealed when the furnace is not in operation.

Newer technologies in home construction have resulted in homes which are more and more "air tight." As a result, these homes are more completely closed and do not allow fresh air to flow into the structure. However, research has shown that a certain amount of fresh air flow is needed to dilute man-made household pollutants which may exist in a home, such as formaldehyde found in paints, volatile organic compounds found in sealants, and toluene found in binders. In order to combat these pollutants, efforts have been made in the area of furnace filter designs to improve the quality of indoor air. However, due to maintenance problems and certain design limitations, these furnace filters do not adequately remove harmful pollutants.

In general, when fresh air flow is increased, the indoor air quality is also increased. At least in part due to these concerns regarding the introduction of fresh air into modern homes, changes were made in the 1991 Uniform Mechanical Code (UMC) provisions regarding fresh air introduction for furnaces with respect to air supply. The UMC now requires that a fresh air intake of 15 cubic feet per minute (cfm) per person be supplied by an outside source. Section 706 of the UMC states:

> Circulating air shall be taken from outside the building or from the conditioned space, or both. Heating systems regulated by this code and designed to replace required ventilation shall be arranged to discharge into the conditioned space not less than the amount of outside air specified in the Building Code.

A typical ventilation standard which is used by many engineers is the American Society of Heating, Refrigeration, and Air-Conditioning Engineers Standard 62-1989. This standard recommends 0.35 air changes per hour, but not less than 15 cfm per person fresh air flow.

Attempts have been made to meet this standard by providing a "passive" fresh air system. This passive fresh air system utilizes an air duct that connects an outside air source to the return air duct of the furnace system via a fresh air supply duct. In this passive fresh air system, fresh air is drawn into the return air duct simply from the suction generated by the main blower fan of the furnace. Thus, these passive systems have been designed to rely upon the main blower fan of the furnace to provide the required amount of suction so that a minimum of 15 cfm per person of fresh air is drawn into the return air duct of the furnace system. This passive system does not regulate the amount of fresh air actually entering the system and does not ensure that the standard of 15 cfm per person of fresh air is being met.

Along with the above disadvantages, the passive fresh air systems being used do not prevent fresh air from flowing into the return air duct of the furnace when the main blower fan of the furnace is not operating. Thus, unwanted outside air can enter the return air duct of the furnace system even when the main blower fan of the furnace is not in operation. Unwanted cold air increases the amount of heating the furnace must accomplish, which in turn increases the overall energy costs to the consumer. Further, the entrance of cold air into the return air duct in extremely cold environments can result in damage to pipes which may exist in and around the furnace.

Additional problems also exist when excess cold air enters the return air duct of the furnace system. The cold air may cause the products of combustion (principally carbon monoxide, carbon dioxide and water vapor) to condense on the inner surface of the heat exchanger. This condition creates an environment in which the combustion gasses begin to condense out and cause the formation of carbonic acid. This carbonic acid may damage the interior of the furnace through corrosion, causing a reduction in the useful life of the furnace. If a sufficient amount of corrosion takes place, a health hazard may exist if cracks form in the heat exchanger. The existence of cracks in the heat exchanger can cause the heating chamber to fracture which may allow carbon monoxide to mix with the heated air in the room, or to be exhausted improperly. As is well known, carbon monoxide poisoning can lead to illness and sometimes death.

Therefore, an electrically controlled damper is needed which can inject the proper volume of fresh air into the return air duct of a furnace system. Further, an electrically controlled damper is needed which will substantially prevent unwanted fresh air from entering the return air duct when the furnace is not in operation.

SUMMARY OF THE INVENTION

It is therefore an object of the present invention to provide an electrically controlled damper which operates to inject the proper volume of fresh air into the return air duct of a furnace system when the furnace is in operation.

It is a further object of the invention to provide an electrically controlled damper which will substantially prevent unwanted fresh air from entering the return air duct of the furnace system when the furnace is not in operation.

It is another object of the invention to provide a damper which allows communication between a fresh air source and a furnace system and which can be effectively insulated from the fresh air source when the damper is in a closed position.

According to one aspect of the present invention, the foregoing and other objects are achieved by a damper unit adapted to be positioned in a furnace duct line. The damper unit has a housing which is in communication with a fresh air source and a furnace system. The housing has a damper blade which is moveable between an open position which allows air flow through the housing and a closed position which prevents air flow through the housing. The blade is coupled with a solenoid so that when the solenoid is activated the blade is moved to an open position allowing air flow through the housing. Further, a fan is located in the housing adjacent the damper blade. The fan operates to move air into and out of the housing and across the damper blade when the damper blade is in its open position.

In another aspect of the invention, a pair of sealing ridges are provided on the interior of the housing. When the damper blade is in a closed position, it is in abutting relationship with the sealing ridges so that air flow across the closed damper blade is substantially prevented by the damper blade and the sealing ridges.

Additional objects, advantages, and novel features of the invention will be set forth in part in the description which follows, and in part will become apparent to those skilled in the art upon examination of the following, or may be learned from practice of the invention. The objects and advantages of the invention may be realized and attained by means of the instrumentalities and combinations particularly pointed out in the appended claims.

BRIEF DESCRIPTION OF THE DRAWINGS

In the accompanying drawings which form a part of the specification and which are to be read in conjunction therewith and in which like reference numerals are used to indicate like parts in the various views.

DETAILED DESCRIPTION OF THE PREFERRED EMBODIMENT

Figure 1:
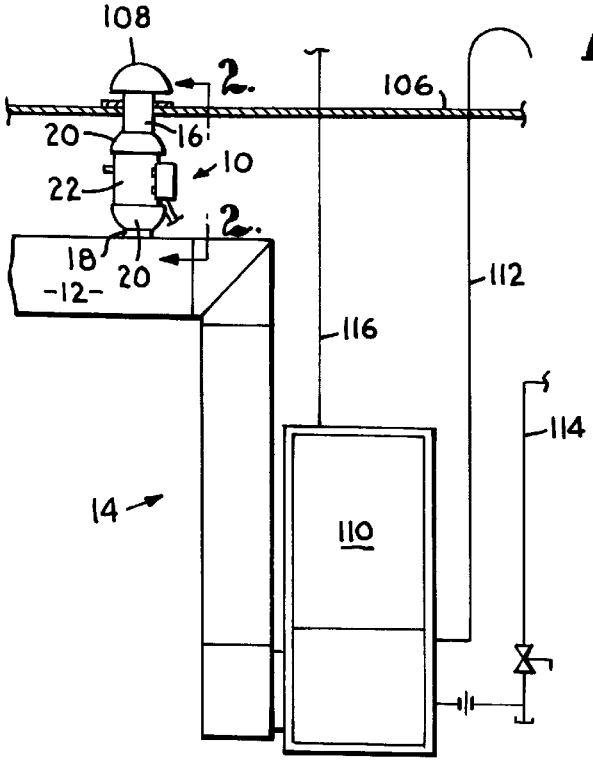
FIG. 1 is a partially schematic perspective view of a furnace system using the motorized damper according the present invention.
Figure 2:
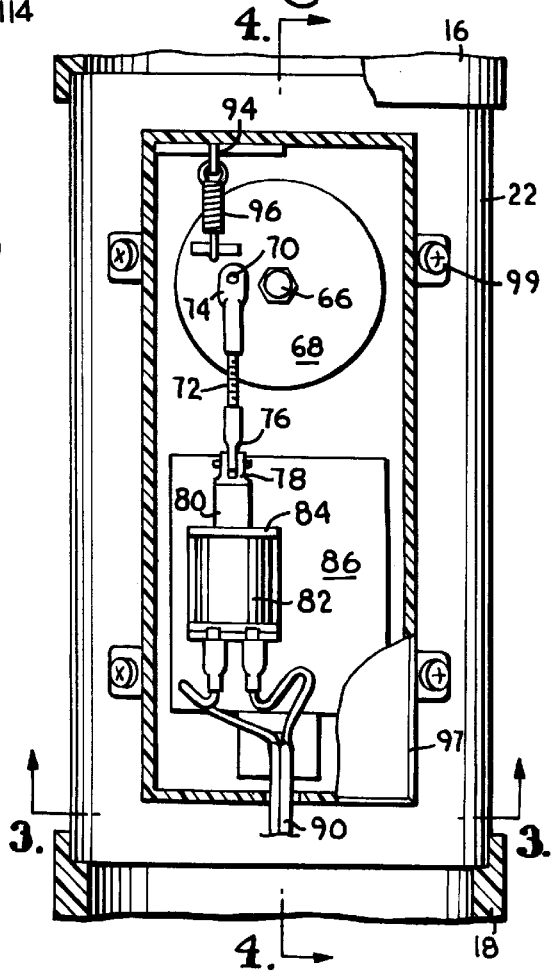
FIG. 2 is a side elevation view taken along line 2—2 of FIG. 1, with parts being partially broken away to show particular features of construction.
Figure 4:
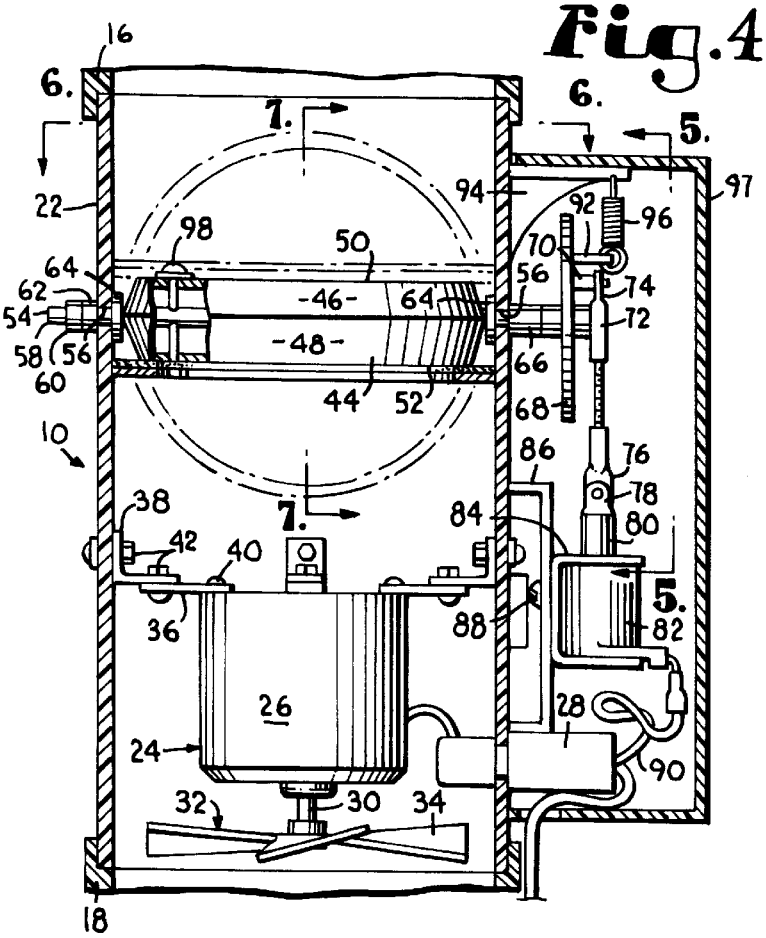
FIG. 4 is a sectional view taken along line 4—4 of FIG. 2, with the blade shown in an open position in broken lines.

Referring now to the drawings in greater detail and initially to FIGS. 1, 2 and 4, a damper in accordance with the present invention is represented broadly by the numeral 10. Damper 10 is used to couple a return air duct 12 of a furnace system 14 with air from outside the building or structure. Damper 10 is typically coupled to return air duct 12 via duct sections 16 and 18. Located on opposite ends of damper 10 are partially spherical end caps 20. End caps 20 operate to couple duct sections 16 and 18 with damper 10.

Figure 3:
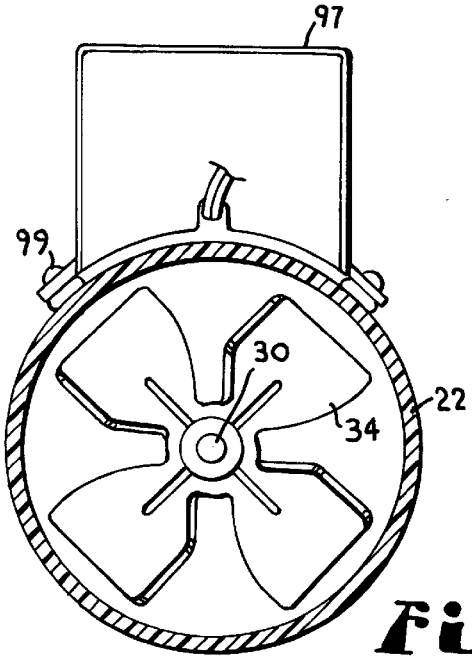
FIG. 3. is a sectional view taken along line 3—3 of FIG. 2.

Referring more particularly to FIGS. 2 through 4, damper 10 includes an outer housing 22 to which end caps 20 are attached. Preferably, in this embodiment, housing 22 is cylindrically shaped. Located within housing 22, and attached thereto is a fan 24 sized to deliver a desired amount of fresh air into furnace system 14. Fan 24 is used to move air through damper 10, as is more fully described below. Fan 24 is equipped with a motor 26 which is operably connected to an electrical supply 28 and a controller (not shown). Attached to a shaft 30 of motor 26 is a fan blade 32. Fan blade 32 is shown in FIG. 3 having four fins 34, although more or less fins could be used. Fan 24 is held within housing 22 via mounting arms 36 and angle brackets 38. Mounting arms 36 are fixed to motor 26, such as by screws 40. Mounting arms 36 are coupled to angle brackets 38 with bolts 32 and angle brackets 38 are coupled to housing 22 with bolts 42. This method of attachment of fan 24 allows motor 26 to be replaced should it malfunction.

Figure 5:
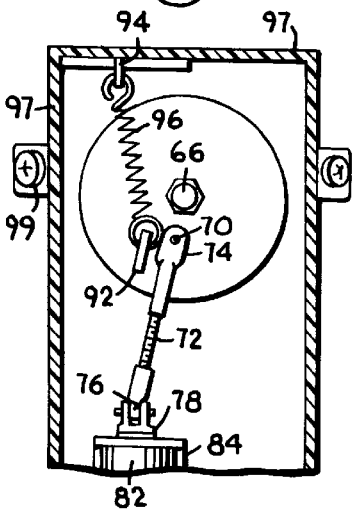
FIG. 5 is a partial sectional view taken along line 5—5 of FIG. 4, with the actuating means shown in a position such that the damper blade would be open.
Figure 6:
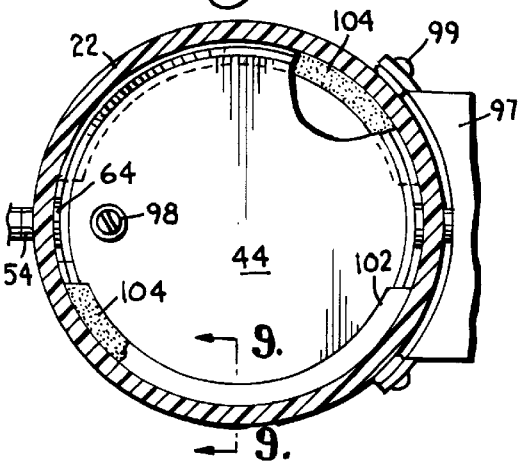
FIG. 6 is a sectional view taken along line 6—6 of FIG. 4 with parts being broken away to show particular details of construction.

In operation, fan 24 cooperates with a damper blade 44 which is pivotally mounted to housing 22. Damper blade 44 has an upper section 46 and a lower section 48 which are each in the shape of a truncated cone. Upper section 46 and lower section 48 are oriented relative to each other so that the diameter existing where upper section 46 and lower section 48 meet is slightly greater than the diameter existing at a top surface 50 of upper section 46 and a bottom surface 52 of lower section 48. Upper section 46 and lower section 48 form a hollow interior which may contain an insulating material (not shown). Alternatively, damper blade 44 can be made from a solid block of plastic material. Extending through damper blade 44 is a cylindrical pivot pin 54. Pivot pin 54 extends through a pair of opposing through holes 56 in housing 22. Through holes 56 may be fitted with bearings or bushings, which are not shown. A first end 58 of pivot pin 54 is held in place with a nut 60 and washer 62. Disposed in the interior of housing 22 along pivot pin 54 and on opposing ends of damper blade 44 are a pair of washers 64. The end of pivot pin 54 opposite first end 58 is threaded into a crank shaft 66 located exteriorly of housing 22. The crank shaft 66 is rigidly secured to a circular crank 68 as best seen in FIGS. 4, 5 and 6, and which is more fully described below.

Crank 68 has extending therefrom a linking pin 70 which is rigidly secured to crank 68. Linking pin 70 is used to secure a connecting rod 72 to crank 68. Connecting rod 72 has a first end 74 which is pivotally connected through linking pin 70 to crank 68. Connecting rod 72 has a second end 76 which is pivotally connected to a coupling 78 on a solenoid shaft 80 of a solenoid 82. Solenoid 82, connecting rod 72 and crank 68 are used to impart a pivoting motion on damper blade 44. Solenoid 82 is held in place relative to housing 22 with a holding bracket 84 and a spacer bracket 86 as best seen in FIG. 4. Holding bracket 84 may be secured to spacer bracket 86 via rivet 88 and spacer bracket 86 may be held in place on housing 22 with any suitable attachment means such as by an adhesive or welding. Solenoid 82 is connected to an electrical supply and a controller (not shown) via wires 90.

Located adjacent linking pin 70 on crank 68 is an eyelet 92. Eyelet 92 is rigidly secured to crank 68, such as by welding. Extending between eyelet 92 and a support 94 is an extension spring 96 as best seen in FIGS. 2, 4 and 5. Extension spring 96 operates to bias damper blade 44 to a closed position. A protective cover 97 is secured to housing 22 and over solenoid 82, connecting rod 72 and crank 68. Cover 97 is secured to housing 22 with screws 99, although other attaching means could be used.

Figure 8:
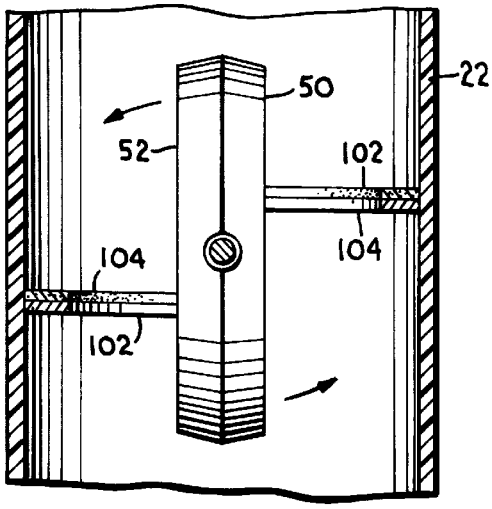
FIG. 8 is a view similar to FIG. 7 with the damper blade shown in an open position.

As shown in FIG. 4, damper blade 44 is in its closed position. In this position solenoid 82 is not energized. Thus crank 68, extension spring 96 and connecting rod 72 are in position as shown in FIGS. 2 and 4. When it is desired to open damper blade 44, solenoid 82 is energized and crank 68, connecting rod 72 and extension spring 96 will assume the position shown in FIG. 5. When solenoid 82 is energized, a rotating motion is imparted upon pivot pin 54. Damper blade 44 is secured to pivot pin 54 through a connecting bolt 98 so that damper blade 44 rotates with pivot pin 54. Thus, with solenoid 82 energized, damper blade 44 will assume a position as best seen in FIG. 8. In this position, air is permitted to flow through housing 22.

Figure 7:
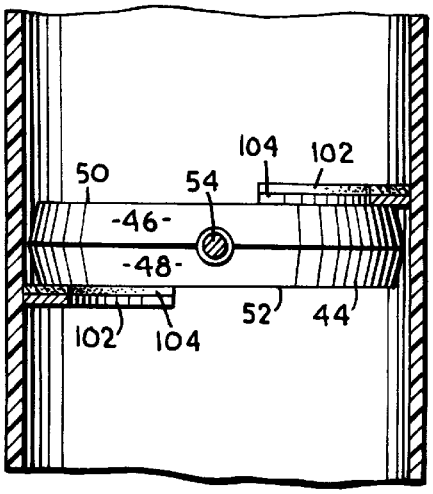
FIG. 7 is a sectional view taken along line 7—7 of FIG. 4, with the damper blade shown in its closed position.
Figure 9:
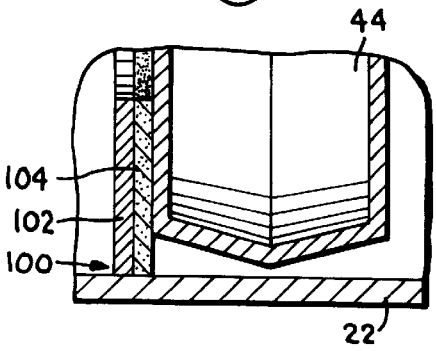
FIG. 9 is an enlarged sectional view taken along line 9—9 of FIG. 6.

When solenoid 82 is de-energized, damper blade 44 will return to a closed position caused by extension spring 96, as best seen in FIG. 7. In the closed position, damper blade 44 is in abutting relationship with a pair of sealing ridges 100. Ridges 100 are constructed from a rigid seal support 102 and a sealing material 104. Material 104 may be secured to support 102 through any suitable attaching means, such as by an adhesive. As best seen in FIG. 6, sealing ridges 100 are generally semi-circular in shape, but do not extend to a full semi-circle. This is necessary to allow damper blade 44 to pivot to its open position as best seen in FIGS. 7 and 8. The outer-most diameter of damper blade 44 is sized to allow clearance between the outer diameter and housing 22 as best seen in FIG. 9.

In use, as best seen in FIG. 1, damper 10 is placed in furnace system 14 intermediate return air duct 12 and the exterior of the structure. Duct section 16 extends from damper 10 through a roof 106, and has a protective end cap 108 thereon. Furnace system 14 is provided with a furnace 110 to which is coupled an air supply source 112, a gas supply source 114 and return air duct 12. Air supply 112 and return air duct 12 supply furnace 110 with the necessary combustion air and gas supply source 114 supplies furnace 110 with combustion gasses. Furnace 110 is also equipped with a vent 116 which extends beyond roof 106.

In use, damper 10 is coupled to a controller so that damper 10 will supply fresh air to return air duct 12 when furnace 110 is in operation. More specifically, when the main blower fan of furnace 110 is in operation, a signal is sent to solenoid 82 which activates solenoid 82 and retracts solenoid shaft 80. This retraction of solenoid shaft 80 operates through connecting rod 72 to rotate crank 68. The rotation of crank 68 effects a pivoting motion on pivot pin 54 and therefore a pivoting motion on damper blade 44. The damper blade in its open position can best be seen in FIG. 8. In this open position, air is allowed to pass through housing 22 and into return air duct 12. Further, when solenoid 82 is energized a signal is simultaneously sent to fan 24 to activate the fan and turn fan blade 32. Thus, not only will damper blade 44 be in an open position, but fan 24 will be operating to pull air from the exterior of the structure into return air duct 12. When the main blower fan of the furnace ceases to operate, solenoid 82 is de-energized, as is fan 24. Spring 96 will then return damper blade 44 to a closed position. Damper blade 44 cooperates with sealing ridges 100 to prevent air flow through housing 22. Thus, damper 10 operates to inject a desired volume of fresh air to the return air duct of a furnace system when the main blower fan of the furnace is in operation. Further, damper 10 will prevent unwanted fresh air from entering the return air duct of the furnace system when the furnace is not in operation.

Figure 10:
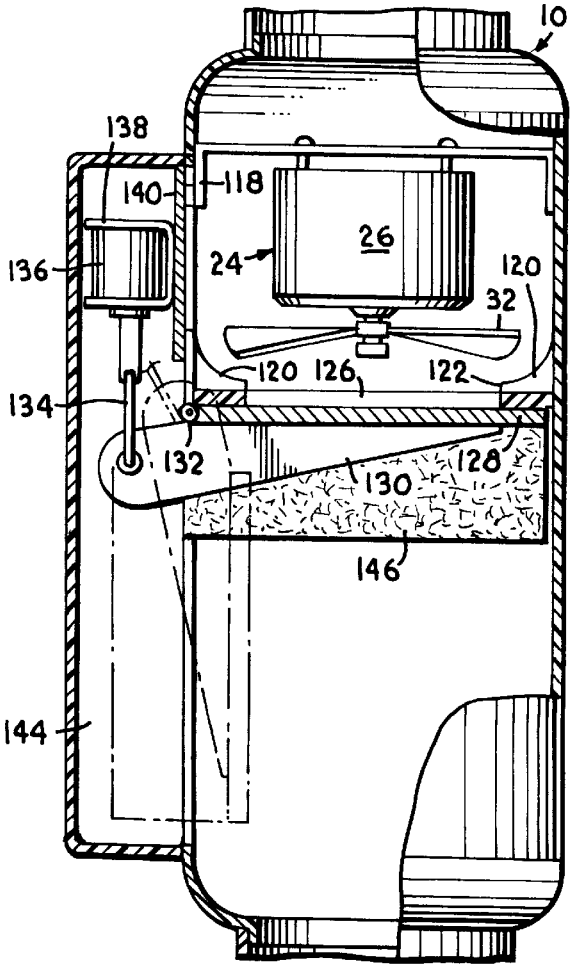
FIG. 10 is a side elevational view of an alternate embodiment of the present invention with parts being broken away to show particular details of construction.
Figure 11:
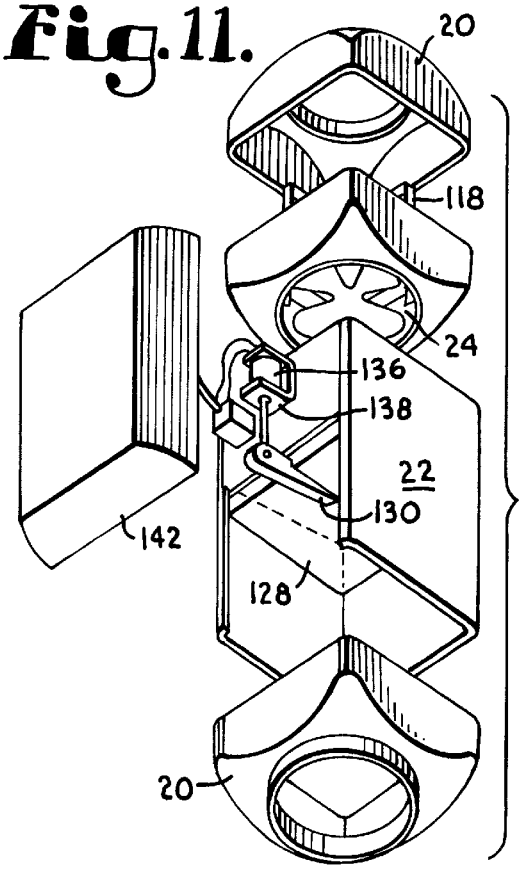
FIG. 11 is an exploded perspective view of the embodiment shown in FIG. 10.

An alternative embodiment of damper 10 is shown in FIGS. 10 and 11. In this embodiment endcaps 20 are again used on either side of a housing 22. In this embodiment, housing 22 defines a portion which is only surrounded on three sides, as can best be seen in FIG. 11. Further, in this embodiment housing 22 is generally rectangularly shaped. In this embodiment, fan 24, and more particularly motor 26, is held within housing 22 near an upper end thereof with mounting arms 118. Mounting arms 118 are secured to housing 22 such as by welding or bolts. Disposed interiorly of housing 22 below fan 24 is a lip 120 which extends completely about the interior perimeter of housing 22. Lip 120 defines a central opening 122 which is slightly smaller than the diameter of fan blade 32. Lip 120 has a lower surface 124 on which is secured a sealing gasket 126. Disposed immediately below gasket 126 is a damper blade 128.

Damper blade 128 is generally rectangular and operates to completely seal opening 122 when damper blade 128 is in abutting relationship with sealing gasket 126. Damper blade 128 is fixedly secured to a lever arm 130 which is in turn hingedly connected to housing 22 at a pivot point 132. Lever arm 130 is pivotally connected to a connecting link 134 which is in turn pivotally connected to a solenoid 136. Solenoid 136 is secured to housing 22 via a holding bracket 138 and a spacer bracket 140. A cowling 142 is placed on housing 22 to cover solenoid 136, connecting link 134 and lever arm 130. Cowling 142 defines an interior space 144 which allows damper blade 128 to pivot to an entirely open position as best seen in broken lines in FIG. 10. Further, damper blade 128 may have secured thereto a layer of insulation 146. Cowling 142 may be sized so as to allow blade 128 with insulation 146 thereon to pivot to a completely open position. When damper blade 128 is pivoted to its completely open position, damper blade 128 is completely away from the opening 122 formed in lip 120. In this manner, damper blade 128 can be pivoted so as to not interfere with the overall cross-sectional area of housing 22. In this embodiment, fan 24 is located on the exterior side of damper blade 128 so that when fan 24 is activated and damper blade 128 is pivoted to its open position, air will be pushed through opening 122 and across damper blade 128. The invention as shown in this embodiment is used as described above for the previous embodiment of damper 10.

Therefore, the invention provides a damper which can meet the current requirements of the Uniform Mechanical Code for providing fresh air to a furnace system. Further, the damper of the present invention provides an electrically controlled damper which is designed to seal off and insulate a fresh air intake duct from the outside environment when the furnace is not in operation.

From the foregoing, it will be seen that this invention is one well-suited to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

We claim:

1. A damper unit adapted to be positioned in communication with a furnace at a furnace duct line for selectively providing fresh air to an indoor environment, comprising:

a housing having an inlet opening in spatial communication with a fresh air source and an exit opening in spatial communication with the furnace duct line;

a damper blade disposed completely in said housing and moveable between an open position which allows the passage of air through said housing and a closed position which blocks the flow of air through said housing;

means for actuating said blade between its open and closed positions; and a fan disposed in said housing adjacent said blade, said fan operating to move air into said housing, across said blade in its open position, out of said exit opening, and into the furnace duct line wherein said actuating means and said fan are electrically connected to the furnace to be simultaneously operated in conjunction therewith.

2. The unit of claim 1 wherein said blade includes an insulative layer which serves to insulate the furnace duct line interior from the exterior environment when said blade is in its closed position.

3. The unit of claim 1 wherein said blade and said fan are operated simultaneously such that, when said blade is in its open position, said fan is operating and, when said blade is in its closed position, said fan is not operating.

4. The unit of claim 3 wherein said actuating means includes a solenoid.

5. The unit of claim 1 wherein said housing and said blade are generally rectangular in shape, said blade pivotally mounted to said housing along one edge of said blade for movement between said open and closed positions.

6. The unit of claim 5 wherein said actuating means includes a lever mounted to said blade, said lever being operatively connected to a solenoid such that operation of said solenoid actuates said blade between its open and closed positions.

7. The unit of claim 5 wherein said housing has a relief area for receiving said blade in its open position such that said blade in its open position does not affect the cross-sectional area of the air flowing through said housing.

8. The unit of claim 1 wherein said housing and said blade are generally circular in shape, said blade being pivotally mounted to said housing generally about an axis extending in diametrical fashion across said blade.

9. The unit of claim 8 wherein said actuating means includes a solenoid used to actuate said blade to its open position.

10. The unit of claim 8 further comprising a pair of generally semi-circular sealing ridges extending from an interior surface of said housing, said sealing ridges longitudinally offset from one another such that when said blade is in its closed position one of said ridges engages one side of said blade and the other of said ridges engages the other side of said blade.

11. The unit of claim 1 further comprising a sealing ridge disposed in said housing for engaging said blade in its closed position so as to seal the furnace interior from the outside environment.

12. The unit of claim 1 wherein said blade in its open position is generally parallel to the longitudinal axis of said housing.

13. The unit of claim 1 wherein said fan is located in said housing between said inlet opening and said blade.

14. The unit of claim 1 wherein said fan is located in said housing between said blade and said exit opening.

15. A damper unit adapted to be positioned in communication with a furnace at a furnace duct line for selectively providing fresh air to an indoor environment, comprising:

a housing having a passageway therethrough, said passageway having an inlet opening in spatial communication with a fresh air source and an exit opening in spatial communication with the furnace duct line;

blocking means, disposed completely in said housing and electrically connected to the furnace, for selectively blocking said passageway to allow and block passage of air therethrough; and forcing means, disposed in said housing and electrically connected to the furnace, for forcing air through said passageway and into the furnace duct line;

wherein said blocking means and said forcing means operate cooperatively with each other and the furnace such that said passageway is open when said forcing means is actuated and the furnace is operating and wherein said passageway is blocked when said forcing means is not actuated and the furnace is not operating.

16. The unit of claim 15 wherein said blocking means includes a centrally pivotal damper blade that aligns with the longitudinal axis of said passageway when said blocking means allows passage of air.

17. The unit of claim 15 wherein said blocking means includes a damper blade pivotally mounted to said housing along one edge of said blade.

18. The unit of claim 15 further comprising a sealing means for sealing said passageway when said passageway is blocked.

19. A damper unit adapted to be positioned in communication with a furnace at a furnace duct line for selectively providing fresh air to an indoor environment, comprising:

a housing having an inlet opening in spatial communication with a fresh air source and an exit opening in spatial communication with the furnace duct line;

a damper blade disposed completely in said housing and moveable between an open position which allows the passage of air through said housing and a closed position which blocks the flow of air through said housing;

means for actuating said blade between its open and closed positions;

a fan disposed in said housing adjacent said blade, said fan operating to move air into said housing, across said blade in its open position, out of said exit opening, and into the furnace duct line wherein said actuating means and said fan are electrically connected to the furnace to be simultaneously operated in conjunction therewith; and a pair of sealing ridges extending from an interior surface of said housing, said sealing ridges longitudinally offset from one another such that when said blade is in its closed position one of said ridges engages one side of said blade and the other of said ridges engages the other side of said blade.

20. The unit of claim 1 wherein said blade is in its open position and said fan is operating when the furnace is operating and said blade is in its closed position and wherein said fan is not operating when the furnace is not operating.

21. The unit of claim 1 wherein said actuating means and said fan are directly connected together with the furnace.

22. The unit of claim 21 wherein said actuating means and said fan are connected to the furnace by physical wiring.

23. The unit of claim 15 wherein said blocking means and said forcing means are directly connected together with the furnace.

24. The unit of claim 23 wherein said blocking means and said forcing means are connected to the furnace by physical wiring.

25. The unit of claim 19 wherein said actuating means and said fan are directly connected together with the furnace.

26. The unit of claim 25 wherein said actuating means and said fan are connected by physical wiring.

27. A damper unit adapted to be positioned in communication with a furnace at a furnace duct line for selectively providing fresh air to an indoor environment, comprising:

a housing having an inlet opening in spatial communication with a fresh air source and an exit opening in spatial communication with the furnace duct line;

a damper blade disposed completely in said housing and moveable between an open position which allows the passage of air through said housing and a closed position which blocks the flow of air through said housing;

an actuator capable of moving said blade between its open and closed positions; and a fan disposed in said housing adjacent said blade, said fan operating to move air into said housing, across said blade in its open position, out of said exit opening, and into the furnace duct line wherein said actuator and said fan are electrically connected to the furnace to be simultaneously operated in conjunction therewith.

* * * * *